US010199733B1

(12) United States Patent
DiNallo

(10) Patent No.: US 10,199,733 B1
(45) Date of Patent: Feb. 5, 2019

(54) MULTIBAND MULTIFILAR ANTENNA

(71) Applicant: Maxtena, Inc., Rockville, MD (US)

(72) Inventor: Carlo DiNallo, San Carlos, CA (US)

(73) Assignee: Maxtena, Inc., Rockville, MD (US)

( * ) Notice: Subject to any disclaimer, the term of this patent is extended or adjusted under 35 U.S.C. 154(b) by 0 days.

(21) Appl. No.: 15/870,917

(22) Filed: Jan. 13, 2018

Related U.S. Application Data

(62) Division of application No. 13/019,497, filed on Feb. 2, 2011, now Pat. No. 9,905,932.

(60) Provisional application No. 61/300,496, filed on Feb. 2, 2010.

(51) Int. Cl.
*H01Q 11/08* (2006.01)

(52) U.S. Cl.
CPC ..... *H01Q 11/08* (2013.01)

(58) Field of Classification Search
CPC ..... H01Q 11/08
USPC ..... 343/893
See application file for complete search history.

(56) References Cited

U.S. PATENT DOCUMENTS

| | | | | |
|---|---|---|---|---|
| 4,554,554 | A | 11/1985 | Olesen | |
| 5,600,341 | A | 2/1997 | Thill | |
| 5,606,332 | A | 2/1997 | Darden | |
| 5,963,180 | A | 10/1999 | Leisten | |
| 6,184,844 | B1 | 2/2001 | Filipovic | |
| 6,653,987 | B1 | 11/2003 | Lamensdorf | |
| 7,372,427 | B2 | 5/2008 | Leisten | |
| 7,408,515 | B2 * | 8/2008 | Leisten | H01Q 9/0421 343/702 |
| 7,425,877 | B2 * | 9/2008 | Casper | H01L 27/016 257/E27.116 |
| 7,675,477 | B2 | 3/2010 | Leisten | |
| 2003/0210206 | A1 | 11/2003 | Phillips | |
| 2005/0243014 | A1 | 11/2005 | Bryan | |
| 2005/0275601 | A1 | 12/2005 | Jostell | |
| 2006/0082517 | A1 | 4/2006 | Chung | |
| 2009/0201215 | A1 | 8/2009 | O'Neill | |

FOREIGN PATENT DOCUMENTS

CN 102227037 B 4/2014

OTHER PUBLICATIONS

English language translation by machine of CN102227037 published Apr. 16, 2014.

* cited by examiner

*Primary Examiner* — Andrea Lindgren Baltzell
(74) *Attorney, Agent, or Firm* — Patents and Licensing LLC; Daniel W Juffernbruch

(57) ABSTRACT

Multi-band quadrifilar antennas that are suitable for satellite communication include composite elements each of which include multiple conductors operating at different frequencies connected to a bus bar. Each composite element is coupled to a signal feed and to a ground structure.

17 Claims, 10 Drawing Sheets

CURVE INFO

LHCP

RHCP

| NAME | THETA | ANG | MAG |
|---|---|---|---|
| m1 | 0.0000 | 0.0000 | 2.8309 |
| m2 | 60.0000 | 60.0000 | -0.4940 |

| NAME | THETA | ANG | MAG |
|---|---|---|---|
| m1 | 0.0000 | 0.0000 | 3.4597 |
| m2 | 60.0000 | 60.0000 | 0.7846 |

MULTIBAND MULTIFILAR ANTENNA

BACKGROUND OF THE INVENTION

Field of the Invention

The present invention relates to the field of compact multiband antennas for satellite aided navigation and mobile satellite communications.

Description of Related Art

Currently in the mobile satellite communication and global navigation industries there is a need for compact multiband antennas that can be easily integrated into portable devices or more generally into mobile platforms and equipment. Ideally such antennas should provide a very controlled radiation pattern, with uniform coverage of the upper hemisphere and circular polarization purity, for multipath and noise rejection. The ideal antenna should also be electromagnetically isolated from the chassis or external conductive ground structures that it is mounted on, to enable integration on multiple platforms with minimal redesign.

The fractional-turn Quadrifilar Helix Antenna (QHA) disclosed in US Patent Application Publication 2008/0174501 A1 assigned in common with the present invention, satisfies most of the above requirements. FIG. 1 shows a conventional fractional-turn QHA. Its pattern is nearly hemispherical and can be shaped to favor a particular elevation angle, if needed. Circular polarization is almost ideal over a very wide range of elevation angle. The most compact variant of the QHA has four helical elements with electrical length of about ¼ wavelength fed by a 4-port phase shifting network enforcing the proper phase rotation. A detailed description of the possible implementation of the feeding network can be found in US 2008/0174501 A1 and is omitted here.

When very compact dimensions are targeted an external matching network is necessary. The design of the matching network can be quite challenging because the strong coupling between the different arms requires that the four ports are matched simultaneously. Moreover, the design is intrinsically single band and the only way to cover multiple bands is to use as many antennas. Using multiple antennas, besides being impractical in many cases, is unacceptable in some particular applications, such as L1/L2 GPS navigation, since the difference in phase between the L1 and L2 signals needs to be accurately calibrated.

DESCRIPTION OF THE FIGURES

The present invention will be described by way of exemplary embodiments, but not limitations, illustrated in the accompanying drawings in which like references denote similar elements, and in which.

DETAILED DESCRIPTION OF THE PREFERRED EMBODIMENTS

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention.

According to the present invention compact quadrifilar antennas that do not require external matching are provided. Moreover according to embodiments of the invention multifilar antenna structures that provide multiband coverage while being fed like traditional QHA are provided. In each band multiband antennas according to embodiments of the invention produce very similar patterns and polarization characteristics and otherwise behave as a single band QHA.

Figure 1:
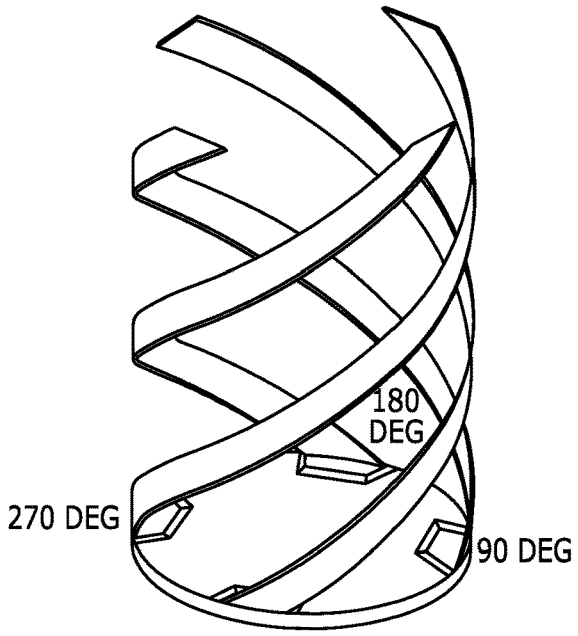
PRIOR ART FIG. 1
FIG. 1 shows a conventional single band quadrifilar antenna and indicates the phasing of a 4 port feeding network for the antenna.
Figure 2:
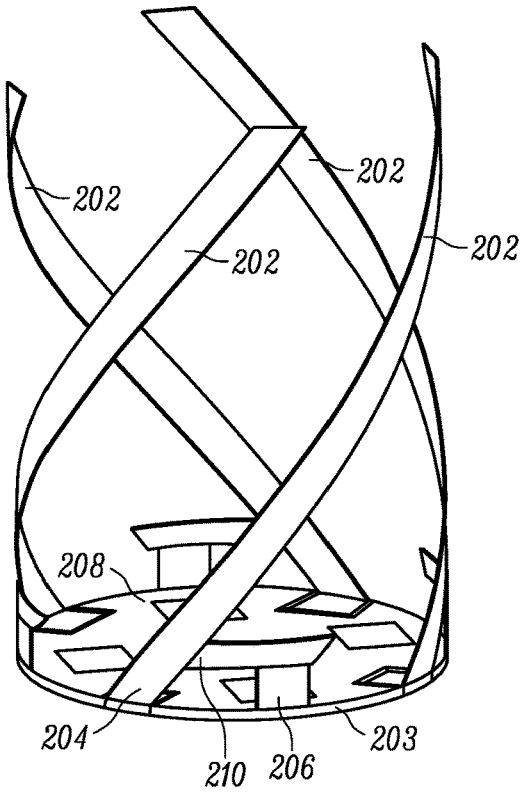
FIG. 2 shows a quadrafilar antenna assembly according to a first embodiment of the invention in which each antenna element is coupled to a PCB structure by a feeding contact and a grounding contact.
Figure 13:
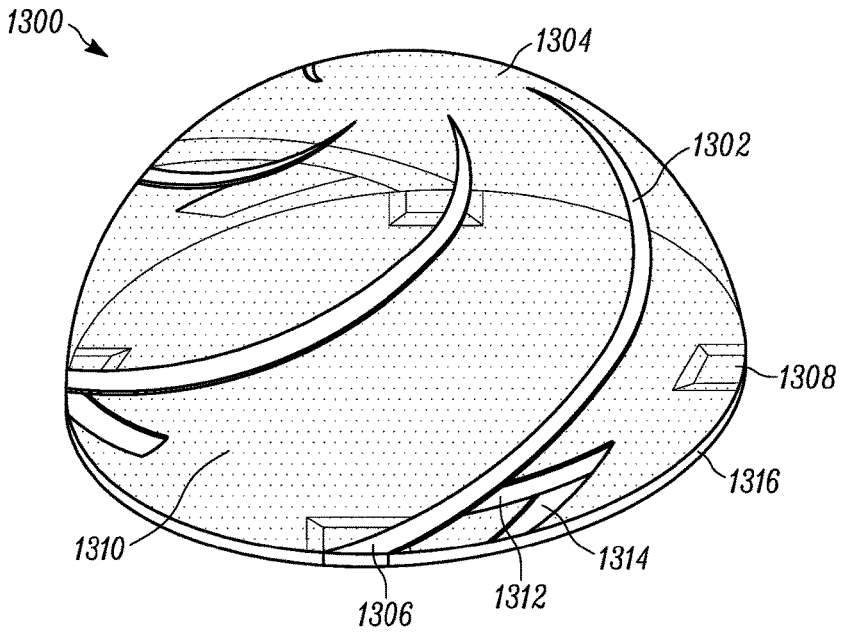
FIG. 13 is an alternative embodiment of the structure described in FIG. 2, where the antenna elements wrap around a hemispherical surface.
Figure 14:
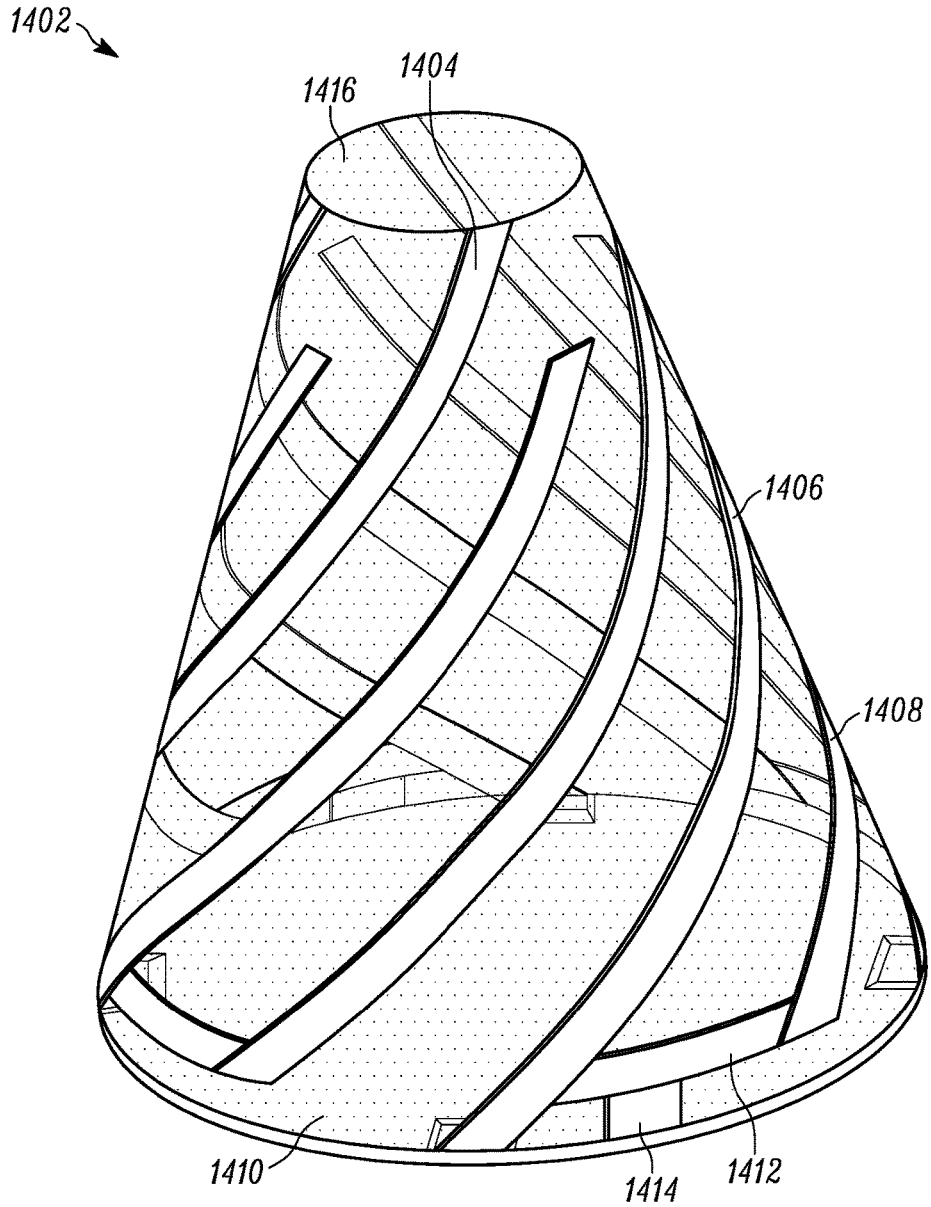
FIG. 14 represents an alternative embodiment of the basic structure depicted in FIG. 3, in which the multifilar elements are wrapped around a frusto-conical surface.

FIG. 2 shows an antenna assembly 200 according to an embodiment of the invention. Each of four elements 202 of approximately ¼ wavelength electrical length contact a circular PCB 203 at a signal feed location 204 and a ground location 206. At the feed location 204 the signal is fed to the element 202 with a phase value chosen to enforce a clockwise or counterclockwise phase rotation around the elements and ultimately produce a Left Hand or Right Hand Circular Polarization. At the second location 206 the element is connected directly to a common ground 208 of the printed circuit board (PCB) 203. A conductive bridge 210 in the form of a small horizontal conductive strip connects the feed and ground couplings providing an ohmic connection between them. The conductive bride is spaced from the printed circuit board 203. The elements 202 are uniformly spaced in azimuth angle and shaped so as to wrap around a cylindrical surface (not shown in the figure) in a helical path. In practice the elements can be supported on an actual cylindrical dielectric body or the elements may be self-supporting. If an actual dielectric body is used, it is suitably made of a low loss tangent material such as ceramic or polycarbonate. According to alternative embodiments the shape of the surface is not necessarily cylindrical, but can be any surface of revolution generated by rotating a curve around the vertical axis of the antenna, including but not limited to conical and hemispherical shape for example as shown in FIG. 13 and FIG. 14.

Figure 3:
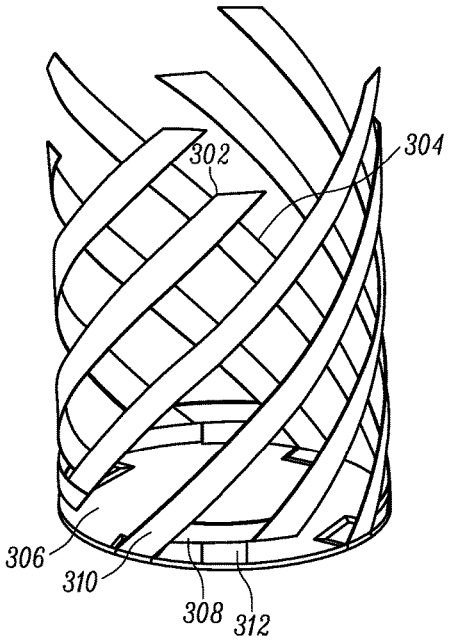
FIG. 3 shows a dual band antenna assembly that includes eight alternating shorter and longer elements that are uniformly spaced around a cylindrical surface according to an embodiment of the invention.

In FIG. 3 eight alternating shorter filar strip-like elements 302 and longer strip-like filar elements 304 are uniformly spaced in angle around a cylindrical surface (not shown in the figure). The longer filar elements 304 extend from coupling terminals (signal feed points) 310 formed on a PCB 306. Each longer element 304 is connected to one shorter element 302 by a horizontal bus strip 308, that extends parallel to and proximate the PCB 306, forming a composite element. For example, the horizontal bus strip is suitably within λ/[100] of the PCB 306. Each composite element is coupled by grounding conductor 312 to a ground plane (one form of ground reference structure) of the PCB 306. The grounding conductor 312 is connected to the horizontal strip 308 at a location between the shorter element 302 and the longer element 304. Each composite element, including one short basic strip-like element 302 and one long basic strip-like element 304, provides a dual band response. The shorter element 302 supports a higher frequency band and the longer element 304 supports a lower frequency band. The center frequency of each band is controlled independently by the physical length of one of the two basic filar elements. If a third strip-like element (not shown) is added a third band of operation is introduced, associated with the length of the third strip-like element. The electrical length of each finger equals (2*n+1)*lambda/4 at the corresponding resonant frequency, where n=0, 1, 2, . . . and lambda is the effective wavelength at the resonant frequency.

Figure 4:
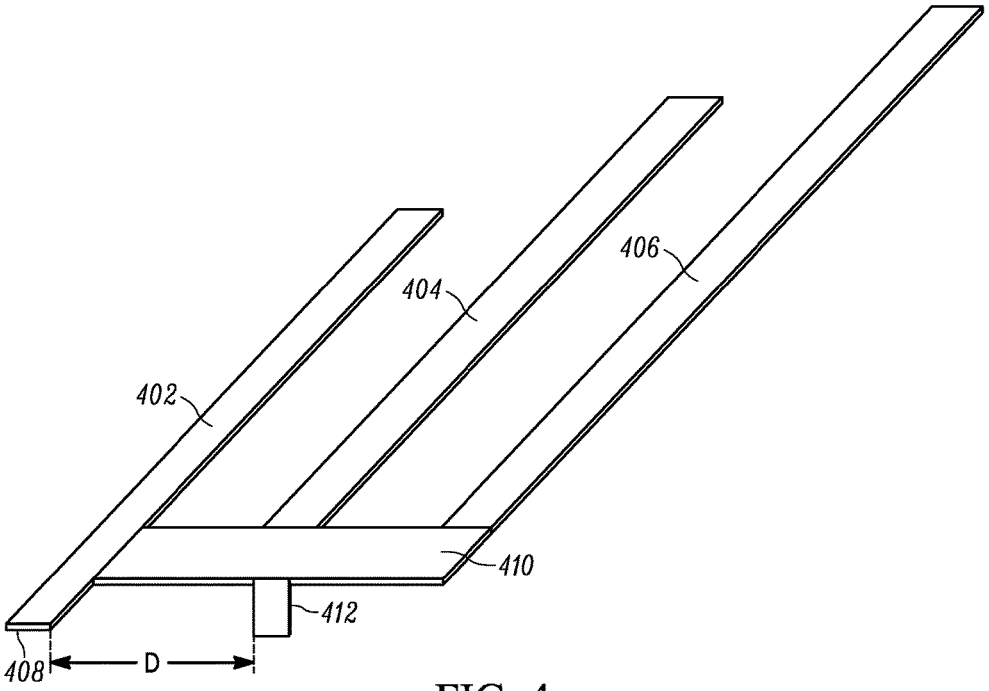
FIG. 4 is a perspective view of a multifilar antenna element with tri-band response as it would appear if unwrapped from its cylindrical support surface and flattened out.

FIG. 4 represents the geometry of the basic building block 400 of a three band antenna according to alternative embodiment of the invention. In FIG. 4 the basic building block 400 is shown unwrapped from a surface of revolution and flattened on a plane in order to more clearly illustrate its structure. The basic building block 400 includes three principle radiating elements 402, 404, 406, including a first band radiating element 402, a longer second band radiating element 404 and a yet longer third band radiating element 406. A proximal end 408 of the first band radiating element 402 serves as a feed contact for the basic building block. In an assembled antenna the proximal end 408 of the first band radiating element will be coupled to a signal feed point of a feed network. Proximal ends of the three radiating elements 402, 404, 406 are connected by a bus strip 410. A grounding strip 412 connects the bus strip 410 to ground. A quadrifilar antenna made from the basic building block 400 would have four such basic building blocks equally spaced in angle, and disposed in a helical configuration on a cylindrical (or other surface of revolution) surface (which may be virtual, or embodied by a physical dielectric support).

Figure 5:
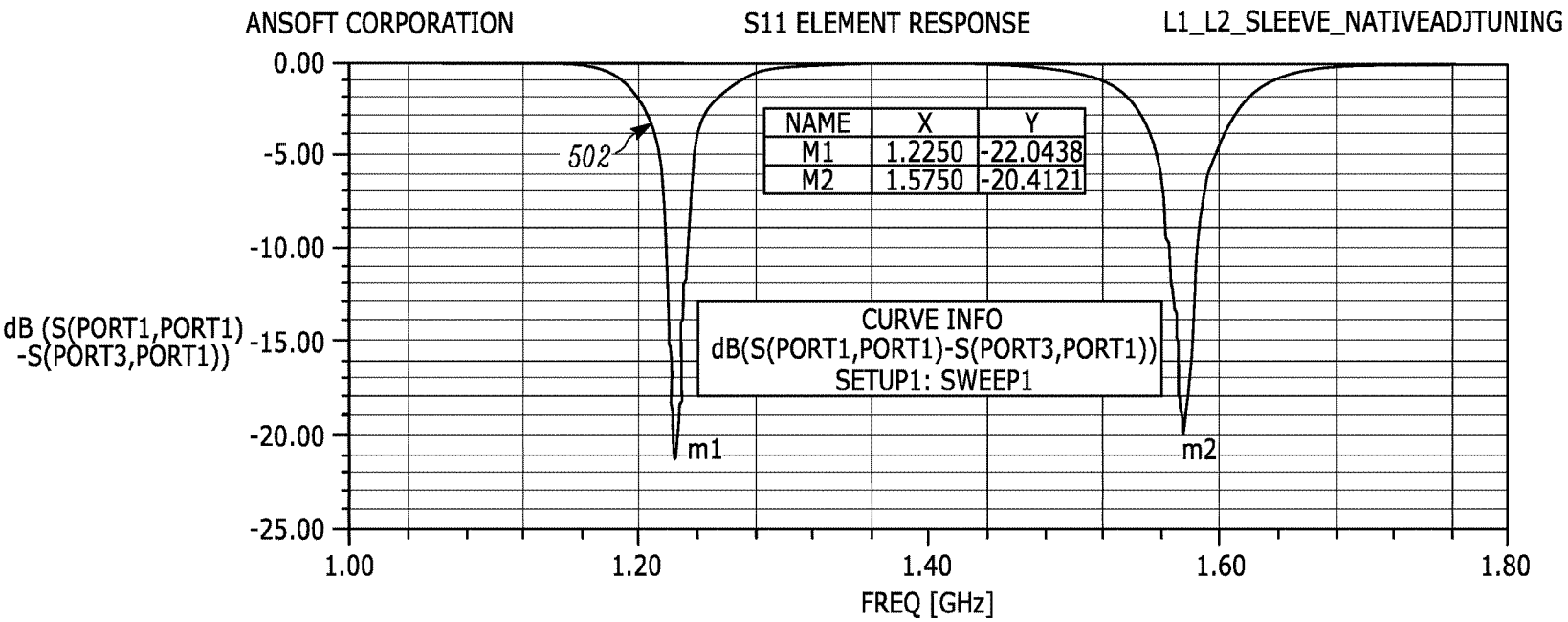
FIG. 5 shows a return loss response of a dual band multifilar antenna according to an embodiment of the invention.

FIG. 5 shows a graph 500 including a return loss response plot 502 for a dual band multifilar antenna according to an embodiment of the invention. The abscissa indicates frequency in Gigahertz and the ordinate indicates return loss in decibels. As shown the return loss includes a first band of operation centered at 1.225 GHz and a second band of operation centered at 1.575 GHz.

Figure 6:
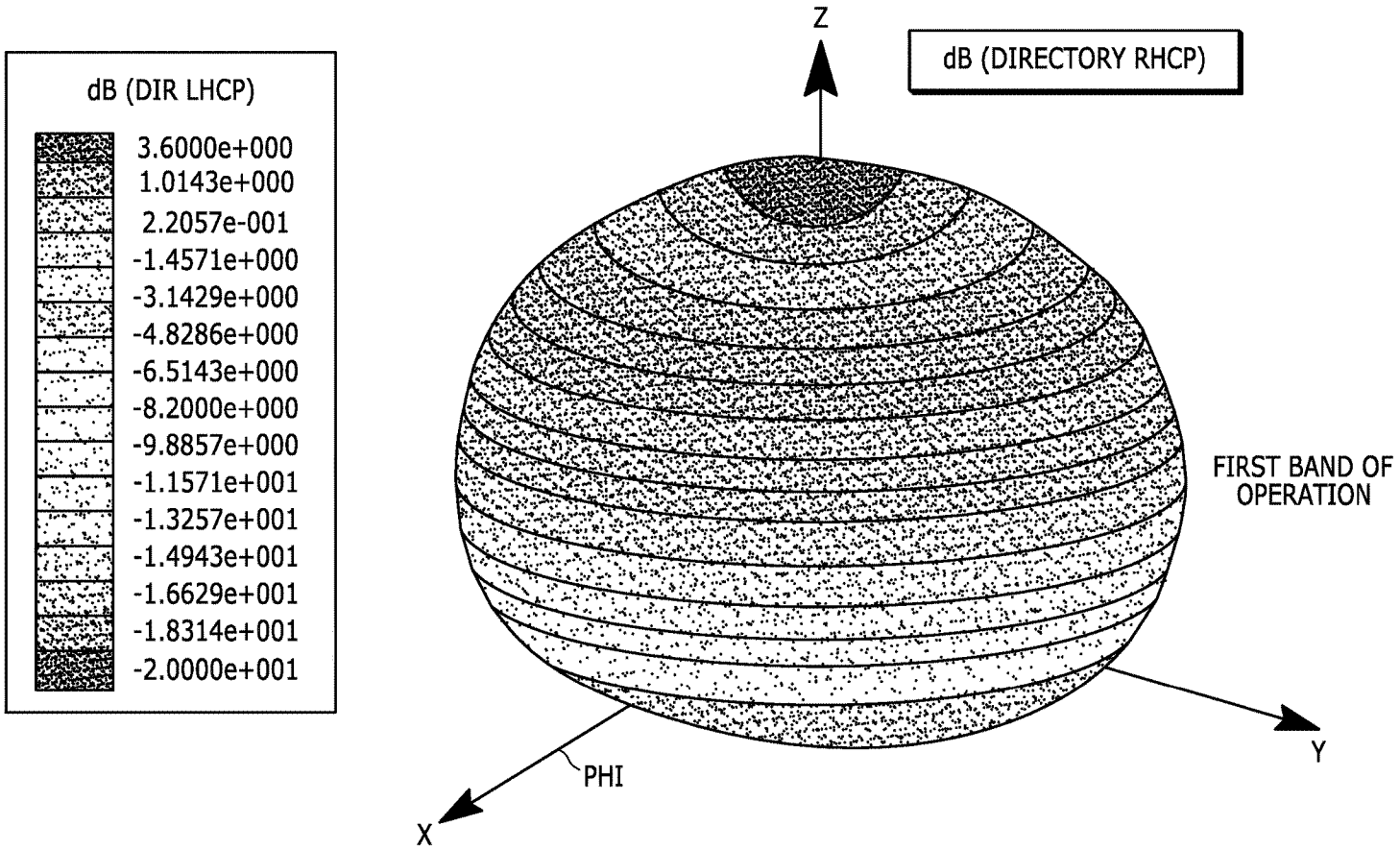
FIG. 6 shows a 3-dimensional radiation pattern for the Right Hand Circular Polarization in the first band of operation for the antenna with the frequency response described in FIG. 3.

FIG. 6 shows a 3-dimensional radiation pattern for the Right Hand Circular Polarization in the first band of operation for the antenna with the frequency response shown in FIG. 3. The radiation pattern is fairly even in the polar angle range 0.0 to 80 degrees varying from a minimum of −1 dB to a maximum of 3 dB. For GPS applications the polar angle range 0.0 to 80 degrees is considered important.

Figure 7:
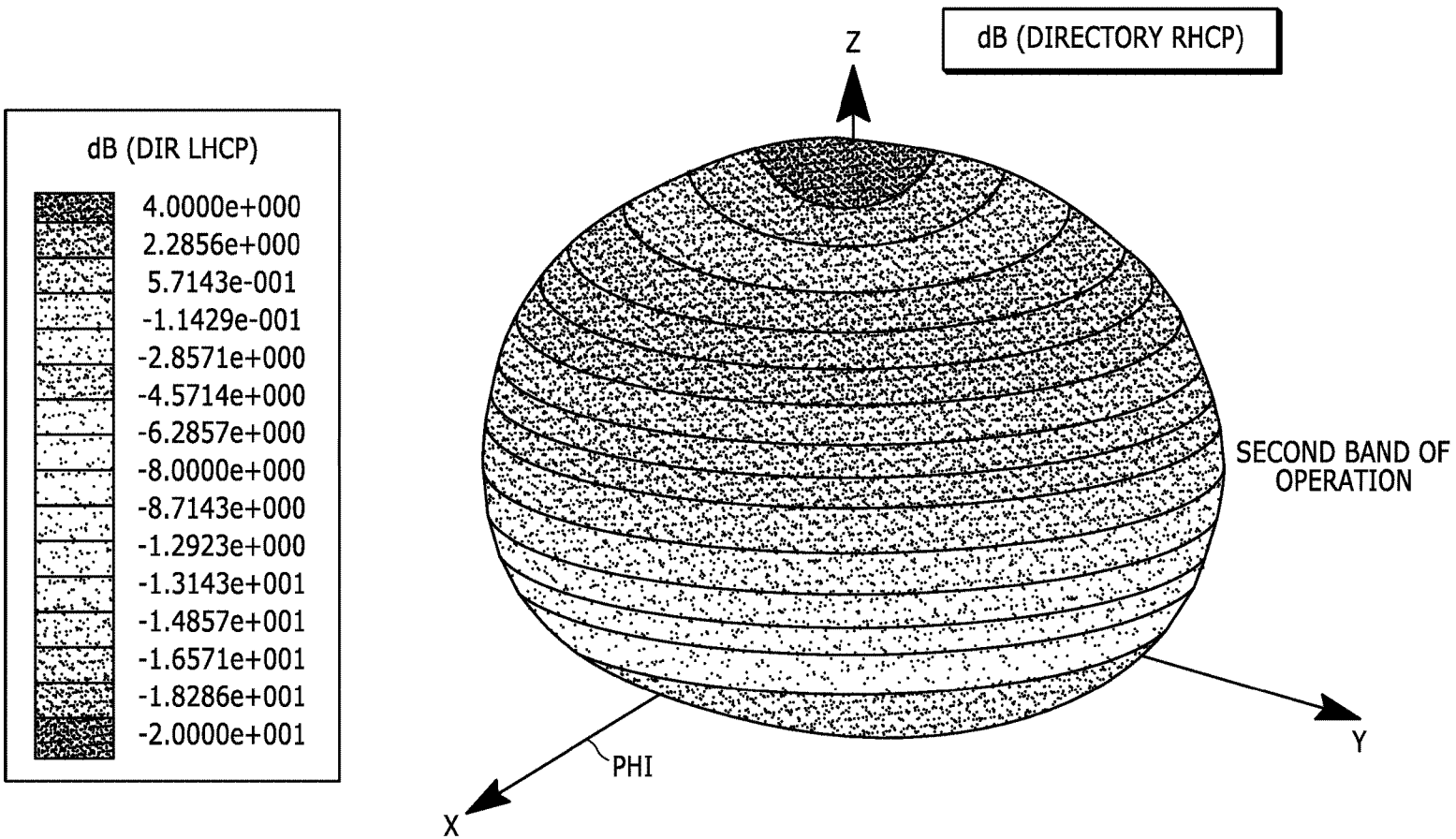
FIG. 7 shows a 3-dimensional radiation pattern for the Right Hand Circular Polarization in the second band of operation for the antenna with the frequency response described in FIG. 3.

FIG. 7 shows a 3-dimensional radiation pattern for the Right Hand Circular Polarization in the second band of operation for the antenna with the frequency response described in FIG. 3. This radiation pattern is also fairly even in the polar angle range 0.0 to 80.0 varying from a minimum of −1 dB to a maximum of 3.5 dB.

Figure 8:
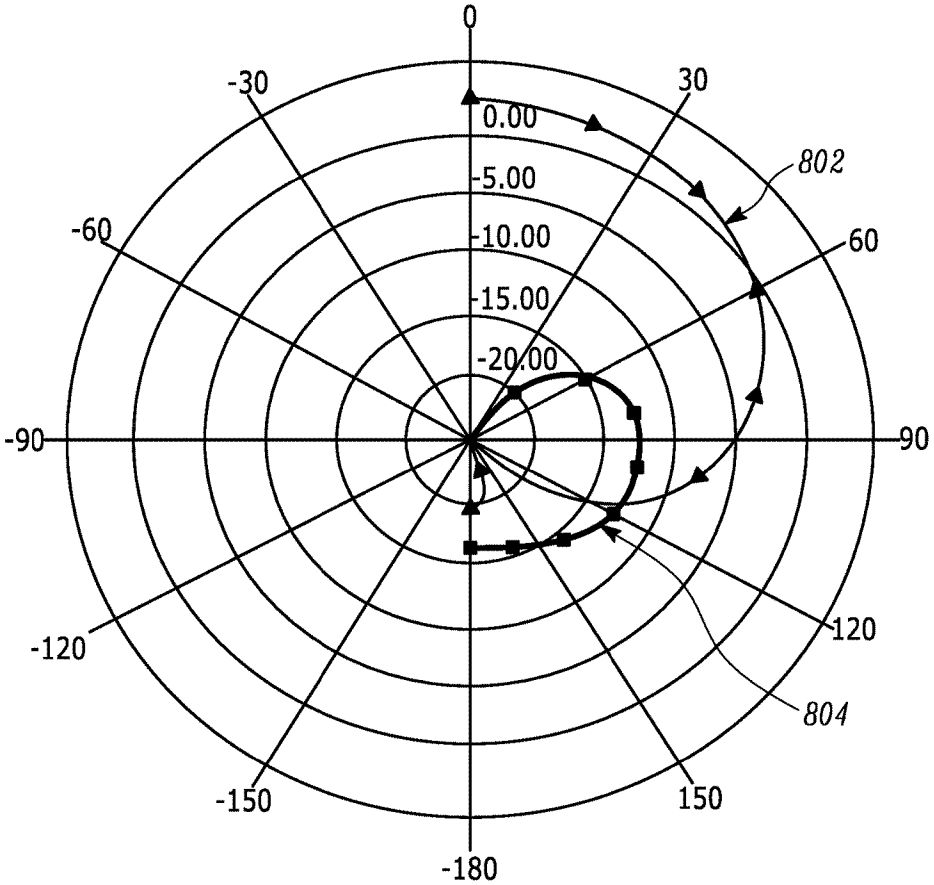
FIG. 8 describes the radiation pattern in a vertical plane (containing the axis of the cylinder) in the first band of operation for the antenna with the frequency response described in FIG. 3.
Figure 9:
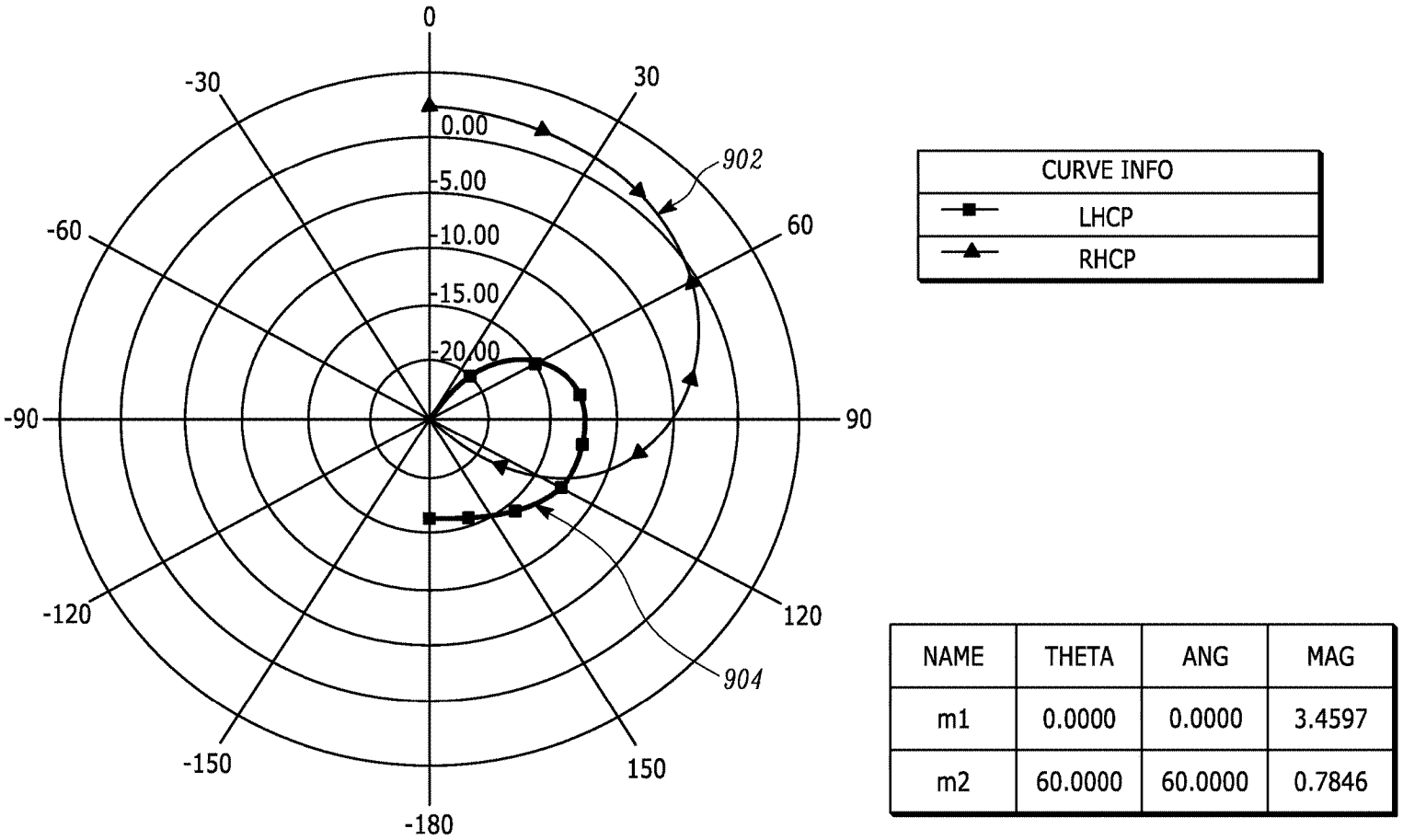
FIG. 9 describes the radiation pattern in a vertical plane (containing the axis of the cylinder) in the second band of operation for the antenna with the frequency response described in FIG. 3.

FIG. 8 is a graph including polar plots 802, 804 of radiated intensity versus polar angle in a vertical plane (containing the axis of the cylinder) in the first band of operation for the antenna with the frequency response described in FIG. 3. A first polar plot 802 is for the Right Hand Circular Polarization (RHCP) component, and a second polar plot 804 is for the Left Hand Circular Polarization (LHCP) component. FIG. 9 is a graph including polar plots 902, 904 of radiated intensity versus polar angle in a vertical plane (containing the axis of the cylinder) in the second band of operation for the antenna with the frequency response described in FIG. 3. A first polar plot 902 is for the RHCP component and a second plot 904 is for the LHCP component. As shown in the FIG. 8 and FIG. 9 graphs, in the polar angle range 0.0 to Pi/2 the RHCP component is strongly dominant over the LHCP component, with an axial ratio of less than 3 dB over the entire upper hemisphere.

Figure 10:
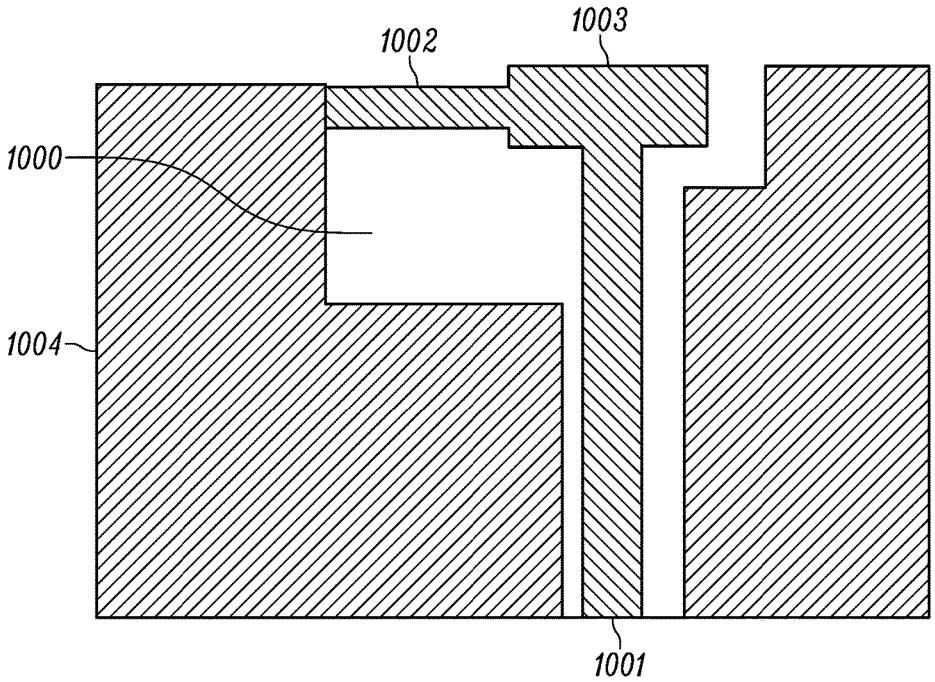
FIG. 10 is a plan view of a co-planar printed circuit board showing how the ground contact can be embedded in the board, by branching the signal at the contact point, and connecting one arm to ground.

FIG. 10 is a fragmentary plan view that shows an alternative arrangement for providing the ground contact analogous to ground contact 206, 312, 314 described above. In the embodiment shown in FIG. 10 the ground contract is provided as part of a co-planar printed circuit board 1000. Referring to FIG. 10 a signal line 1001 extends to a signal pad 1003. The signal pad 1003 is connected to a helical antenna element (1104) of the type described above. A ground plane 1004 is disposed co-planar with and on both sides of the signal line 1001 and signal pad 1003. A ground connection 1002 extends from the signal line 1001 to the ground plane 1004.

Figure 11:
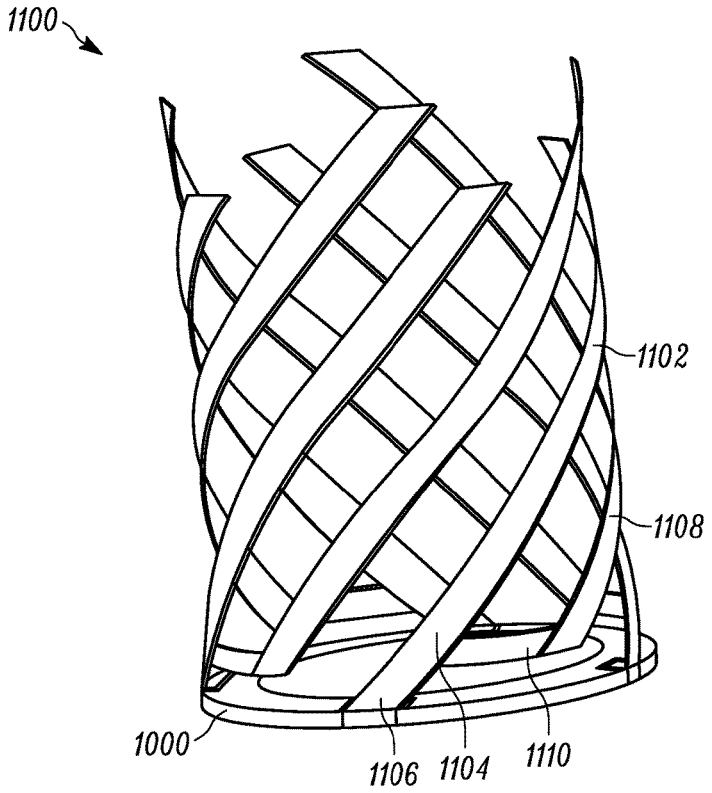
FIG. 11 is an embodiment of the invention showing the geometry of the antenna element when the ground contact function is embedded in the PCB as shown in FIG. 10.

FIG. 11 shows an antenna 1100 that includes the printed circuit board 1000 such as shown in FIG. 10 in which the ground connection 1002 is implemented in the printed circuit board 1000. Note that the printed circuit board 1000 used in the antenna 1100 will have four arrangements of signal line 1001, and ground connection 1002 such as shown in FIG. 10. The antenna 1100 includes four composite elements 1102, each including a first element 1104 tuned to a first frequency and having a proximal end 1106 connected to one of four signal pads 1003, and a second element 1108 that is connected to the first element 1104 by a bridge conductor 1110.

Figure 12:
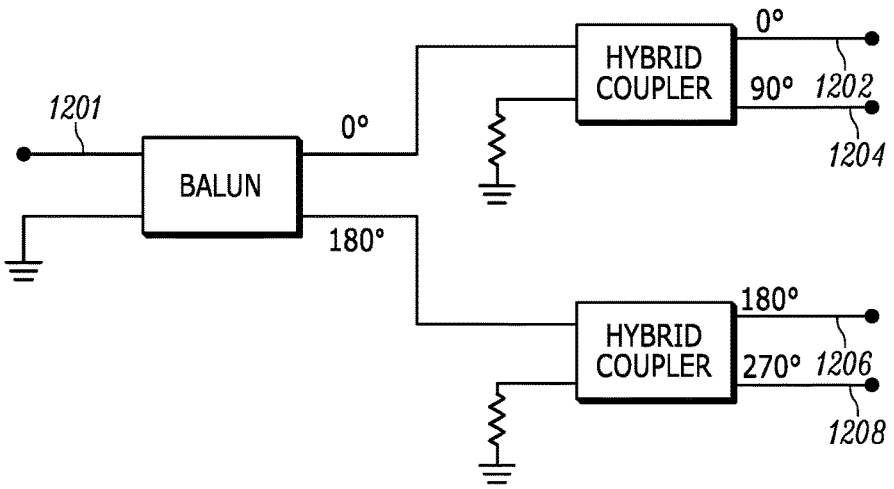
FIG. 12 is schematic illustration of a feed network that is used to feed quadrifilar antennas according to embodiments of the invention.

FIG. 12 represents a schematic of a possible implementation of a feeding network providing the incremental 90 degrees phasing between adjacent elements. The network employs a balun 1212 to convert a common signal into 2 signals having a differential phase relationship between them. Each one of the differential signals is fed to one of two 90 degrees hybrid couplers 1203. The relative phase of each branch is indicated on the figure. The ground contacts 1210 are connected to the common PCB ground, such as for example the ground 306 shown in FIG. 3. A receiver and/or transmitter are coupled to the network through port 1201. Four antenna coupling terminals (signal feed points) 1202, 1204, 1206 and 1208 are connected to the four feed points of the antennas described above, e.g., 310 in FIG. 3. The four antenna coupling terminals 1202, 1204 1206, 1208 are spatially located on a printed circuit board implementation of the feed network (e.g., 203) such that phase increases uniformly (e.g., in 90 degree steps) as a function of position (described by azimuth angle) around the printed circuit board (e.g., 203). The feed network 1200 provides equal amplitude signals to the four antenna coupling terminals 1202, 1204, 1206, 1208.

FIG. 13 shows an antenna 1300 according to an alternative embodiment of the invention. The antenna 1300 comprises four helical antenna elements 1302 conforming to a hemispherical surface 1304. Each antenna element 1302 includes a proximal end 1306 connected to a signal pad 1308 of a printed circuit board 1310 and is connected through a bridge conductor 1312 to a short ground conductor 1314 that extends up from a ground plane 1316 of the printed circuit board 1310.

FIG. 14 shows an antenna 1402 according to alternative embodiment. The antenna 1402 includes four composite antenna elements 1404, each including a first frequency radiating element 1406 and a second frequency radiating element 1408. The first frequency radiating elements 1406 are connected to signal pads of a printed circuit board 1410. The second frequency radiating elements 1408 are coupled to the first frequency radiating elements 1406 through bridge conductors 1412. The bridge conductors 1412 are coupled to a ground plane of the printed circuit board through four short ground conductors 1414. The four composite elements 1404 are conformed to a frusto-conical surface 1416.

For proper functioning of the antenna it is important that the composite element is equipped with a direct contact to the reference PCB ground (e.g., 412 in FIG. 4), along with the feeding contact (e.g., proximal end 408 in FIG. 4), coupling the signal. By means of the ground contact it is possible to attain an antenna matched to the same impedance (e.g., 50 Ohms) in all bands of operation. The value of the matching impedance is controlled by the spacing D, shown in FIG. 4, between the feed contact location (e.g., 408) and the ground contact location (e.g., 412). The value of the spacing D required to obtain a desired impedance Z can be determined by routine experimentation.

Alternatively the ground contact can also be embedded in the PCB, by implementing a branching of the signal coupled to the composite element and connecting one of the paths to ground directly on the PCB, as shown in FIG. 10. In FIG. 10 the signal line 1001 lies in the same plane as the ground plane 1004. The antenna element is connected to the pad 1002. The antenna pad is coupled to ground through the conductor 1003 travelling a distance D chosen to achieve the desired impedance matching. In this case the geometry of the antenna appears as depicted in FIG. 11. Whereas the embodiments described above include 4 antenna elements or 4 composite antenna elements alternatively more than 4 elements or composite elements can be provided.

I claim:

1. An antenna assembly comprising:

a feeding network on a circuit board comprising a plurality of signal feeds and a ground plane, wherein the feeding network comprises a plurality of matching elements, each matching element consisting essentially of a shunt impedance on the circuit board, each of the shunt impedances on the circuit board connecting the ground plane to a corresponding one of the plurality of signal feeds and having a shunt impedance chosen to achieve matching to a predetermined feed impedance of the corresponding one of the signal feeds; and an antenna structure connected to the feeding network, including:

a plurality of first filar antenna elements and a plurality of second filar antenna elements alternately arranged among the first filar antenna elements about a circumference and above the circuit board, wherein the plurality of first filar antenna elements each have a first electrical length and the plurality of second filar antenna elements each have a second electrical length different than the first length, wherein the first electrical length of each of the plurality of first filar antenna elements is an odd multiple of a quarter wavelength of a first operating frequency and wherein the second electrical length of each of the plurality of second filar antenna elements is an odd multiple of a quarter wavelength of a second operating frequency, wherein each of the plurality of first filar antenna elements includes a first end and a second end and the first end is connected to a corresponding one of the plurality of signal feeds and a point between the first end and the second end is coupled to an end of a corresponding one of the second filar antenna elements.

2. An antenna assembly according to claim 1, further comprising a cylindrical surface above and perpendicular to the circuit board, wherein the plurality of first filar antenna elements and the plurality of second filar antenna elements are disposed on the cylindrical surface.

3. An antenna assembly according to claim 1, wherein each of the shunt impedances on the circuit board is a tuning strip having a length chosen to achieve matching to a predetermined feed impedance of the corresponding one of the signal feeds.

4. An antenna assembly according to claim 1, wherein each of the shunt impedances on the circuit board has first and second ends, the first end connected directly to the corresponding one of the plurality of signal feeds and the second end connected directly to the ground plane.

5. An antenna assembly according to claim 4, wherein each of the shunt impedances on the circuit board is a tuning strip on the circuit board having a length chosen to achieve matching to a predetermined feed impedance of the corresponding one of the signal feeds.

6. An antenna assembly according to claim 5, further comprising a cylindrical surface above and perpendicular to the circuit board, wherein the plurality of first filar antenna elements and the plurality of second filar antenna elements are disposed on the cylindrical surface.

7. An antenna assembly comprising:

a feeding network on a circuit board comprising a plurality of signal feeds and a ground plane; and an antenna structure coupled to the feeding network, including:

a plurality of first filar antenna elements and a plurality of second filar antenna elements alternately arranged among the first filar antenna elements about a circumference and above the circuit board, wherein the plurality of first filar antenna elements each have a first length and the plurality of second filar antenna elements each have a second length different than the first length, wherein each of the plurality of first filar antenna elements includes a first end and a second end and the first end is coupled to a corresponding one of the plurality of signal feeds and a point between the first end and the second end is coupled through a respective one of a plurality of conductive strips, each conductive strip substantially parallel to the ground plane of the circuit board to a lower end of a corresponding one of the second filar antenna elements and wherein the lower end of the corresponding one of the second filar antenna elements is coupled to the ground plane through a respective one of a plurality of ground strips, each ground strip directly extending downward below the corresponding second filer antenna element to the ground plane of the circuit board.

8. An antenna assembly according to claim 7, further comprising a cylindrical surface above and perpendicular to the circuit board, wherein the plurality of first filar antenna elements and the plurality of second filar antenna elements are disposed on the cylindrical surface, wherein the plurality of ground strips are disposed on the cylindrical surface, and wherein the plurality of conductive strips are disposed on the cylindrical surface.

9. An antenna assembly according to claim 7, wherein each of the plurality of conductive strips substantially parallel to the ground plane of the circuit board is one of a plurality of tuning strips, each tuning strip having a length chosen to achieve matching to a predetermined feed impedance of the corresponding one of the signal feeds.

10. An antenna assembly according to claim 9, wherein the first length is an electrical length of each of the plurality of first filar antenna elements an odd multiple of a quarter wavelength of a first operating frequency; and wherein the second length is an electrical length of each of the plurality of second filar antenna an odd multiple of a quarter wavelength of a second operating frequency.

11. An antenna assembly according to claim 9, further comprising a cylindrical surface above and perpendicular to the circuit board, wherein the plurality of first filar antenna elements, the plurality of second filar antenna elements are disposed on the cylindrical surface, wherein the plurality of ground strips are disposed on the cylindrical surface, and wherein the plurality tuning strips are disposed on the cylindrical surface substantially parallel to the circuit board.

12. An antenna assembly according to claim 7, further comprising a plurality of third filar antenna elements alternately arranged among the first and second filar antenna elements about the circumference and above the circuit board, wherein each of the plurality of third filar antenna elements includes an end coupled to the lower end of a corresponding one of the second filar antenna elements, wherein the plurality of third filar antenna elements each have a third length different than the first length and different than the second length.

13. An antenna assembly according to claim 12, wherein the end of each third filar antenna element is coupled to the lower end of the corresponding one of the second filar antenna elements by another corresponding conductive strip substantially parallel to the ground plane of the circuit board.

14. An antenna assembly according to claim 12, further comprising a cylindrical surface above and perpendicular to the circuit board, wherein the plurality of first filar antenna elements, the plurality of second filar antenna elements, and the plurality of third filar antenna elements are disposed on the cylindrical surface, wherein the plurality of ground strips are disposed on the cylindrical surface, and wherein the plurality of conductive strips are disposed on the cylindrical surface.

15. An antenna assembly according to claim 7, further comprising a plurality of shunt impedances on the circuit board, each of the shunt impedances connecting the ground plane to a corresponding one of the plurality of signal feeds and having an impedance chosen to achieve matching to a predetermined feed impedance of the corresponding one of the signal feeds.

16. An antenna assembly according to claim 15, wherein the first length is an electrical length of each of the plurality of first filar antenna elements an odd multiple of a quarter wavelength of a first operating frequency; and wherein the second length is an electrical length of each of the plurality of second filar antenna an odd multiple of a quarter wavelength of a second operating frequency.

17. An antenna assembly according to claim 15, wherein each of the shunt impedances on the circuit board is a tuning strip having a length chosen to achieve matching to a predetermined feed impedance of the corresponding one of the signal feeds.

* * * * *